United States Patent [19]

Gillis

[11] Patent Number: 4,770,648

[45] Date of Patent: Sep. 13, 1988

[54] WATER SKI BINDING HAVING AN IN SITU MOLDED BASE ASSEMBLY

[75] Inventor: Donald B. Gillis, Lake Stevens, Wash.

[73] Assignee: Connelly Skies, Inc., Lynnwood, Wash.

[21] Appl. No.: 911,491

[22] Filed: Sep. 24, 1986

[51] Int. Cl.[4] ..... A63C 15/00

[52] U.S. Cl. ..... 441/70; 36/43; 36/93

[58] Field of Search ..... 441/70; 36/28, 43, 44, 36/71, 93, 98; 264/222

[56] References Cited

U.S. PATENT DOCUMENTS

| | | | |
|---|---|---|---|
| 3,089,158 | 5/1963 | Powers | 441/70 |
| 3,119,130 | 1/1964 | Senne et al. | 441/70 |
| 3,121,891 | 2/1964 | Humason, Jr. | 441/70 |
| 3,407,406 | 10/1968 | Werner et al. | 36/98 |
| 3,615,972 | 10/1971 | Morehouse, Jr. et al. | 156/79 |
| 3,895,405 | 7/1975 | Edwards | 36/43 X |
| 4,108,928 | 8/1978 | Swan, Jr. | 264/26 |
| 4,229,546 | 10/1980 | Swan, Jr. | 36/71 |
| 4,255,202 | 3/1981 | Swan, Jr. | 36/71 |
| 4,389,200 | 6/1983 | O'Brien | 441/70 |
| 4,522,603 | 6/1985 | Doyle | 441/70 |
| 4,563,787 | 1/1986 | Drew | 36/43 X |

*Primary Examiner*—Sherman D. Basinger

*Attorney, Agent, or Firm*—Christensen, O'Connor, Johnson & Kindness

[57] ABSTRACT

An in situ molded base assembly (17) for a water ski binding (40) includes a support pad (28) composed of particles of discontinuous microbeads and a liquid phase encapsulated in an envelope to form a layer of viscous, flowable pressure-compensating material. The support pad (28) is preformed into a shape corresponding to the bottom of a foot by placement of the foot on the support pad. The base assembly also includes a soleplate (24) of thermoforming material which is in situ molded by first heating the soleplate above its thermoforming temperature, placing the soleplate over the formed support pad (28) and then standing on the heated soleplate thereby causing the soleplate to conform to the shape of the underside of the foot and the top contour of the footpad and then removing the foot after the soleplate has cooled to a temperature below its thermoforming temperature.

25 Claims, 4 Drawing Sheets

WATER SKI BINDING HAVING AN IN SITU MOLDED BASE ASSEMBLY

TECHNICAL FIELD

The present invention relates to bindings for water skis, and, more particularly, to a binding having a base assembly molded to the shape of the bottom of a skier's foot.

BACKGROUND OF THE INVENTION

Water ski bindings typically have been constructed with an elastic or resilient upper that is directly mounted on the top surface of a water ski or fastened to a baseplate which in turn is mounted on the ski. The upper is shaped to snugly receive and support a skier's foot. Examples of such water ski bindings are disclosed in U.S. Pat. Nos. 3,089,158, 3,119,130, 3,121,891 and 4,389,200.

Although efforts have been made in prior water ski bindings to shape the binding upper to properly support and fit a skier's foot, little emphasis has been placed on incorporating into the binding design the shape of the underside of the skier's foot. For instance, in the U.S. Pat. No. 3,121,891, the skier's foot rests directly on the top surface of a water ski and in U.S. Pat. No. 3,089,158, the skier's foot rests on a flat, rigid plate on which the binding upper is mounted. U.S. Pat. Nos. 4,389,200 does provide a flat, uniform, thickness foam pad and 3,119,130 provides a wedge-shaped neoprene pad which is higher in the rear heel area than the front toe area. However, such pads are not contoured to correspond to the shape of a bottom of a foot and, thus, cannot provide maximum support or comfort for the skier.

A water ski binding having a base assembly contoured into the shape of the bottom of a skier's foot would not only provide better support and comfort over prior binding designs, but also would enhance the skier's safety in several ways. Such a binding would provide a better fit and, thus, give greater control over the ski so that the skier is less likely to sustain an injurious fall.

BRIEF DESCRIPTION OF THE DRAWINGS

The details of a typical embodiment of the present invention will be described in connection with the accompanying drawings, in which.

DETAILED DESCRIPTION OF THE INVENTION

Figure 1:
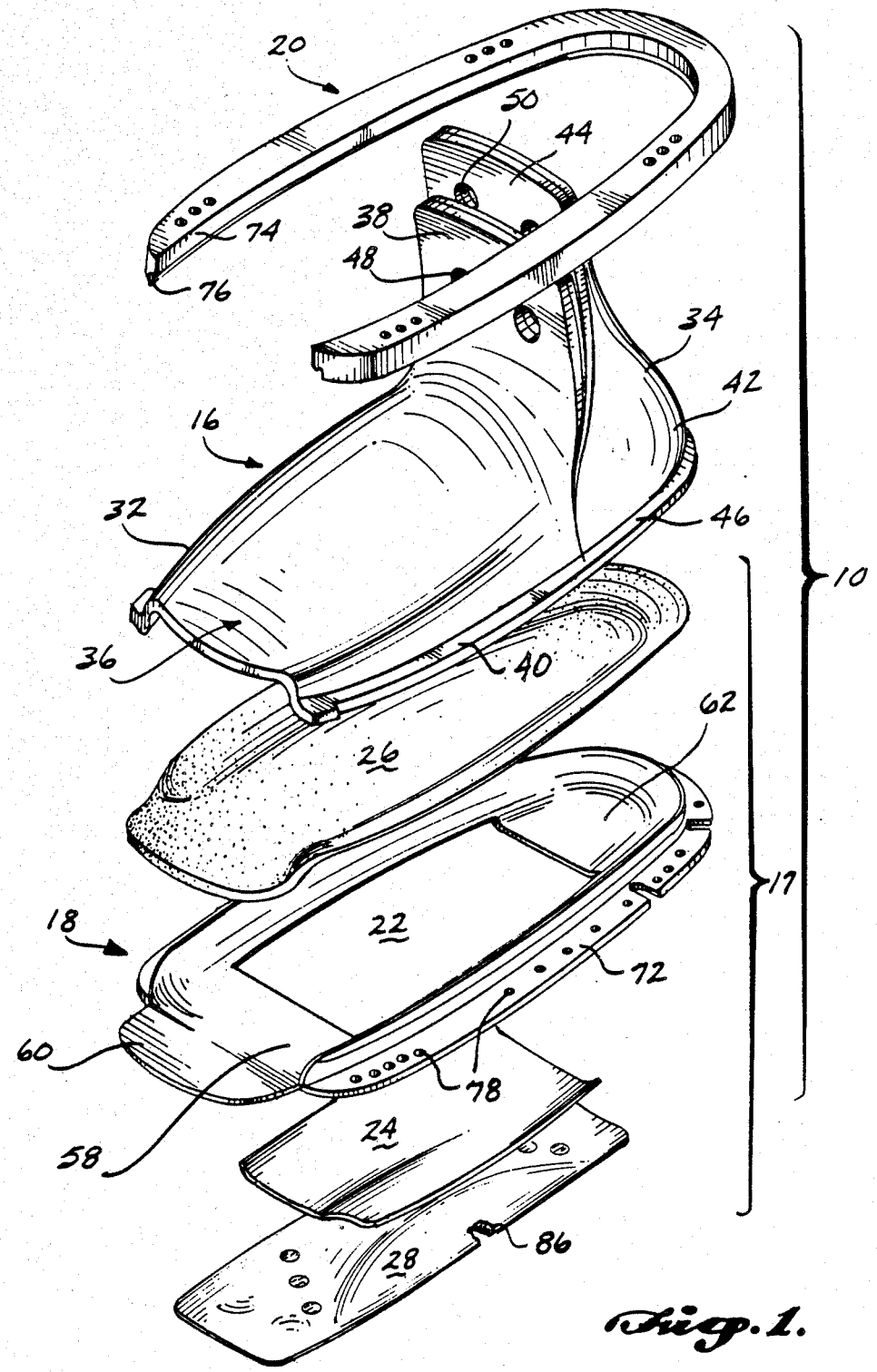
FIG. 1 is an exploded, isometric view of a water ski binding of the present invention, as viewed from the forward and left side of the binding.
Figure 2:
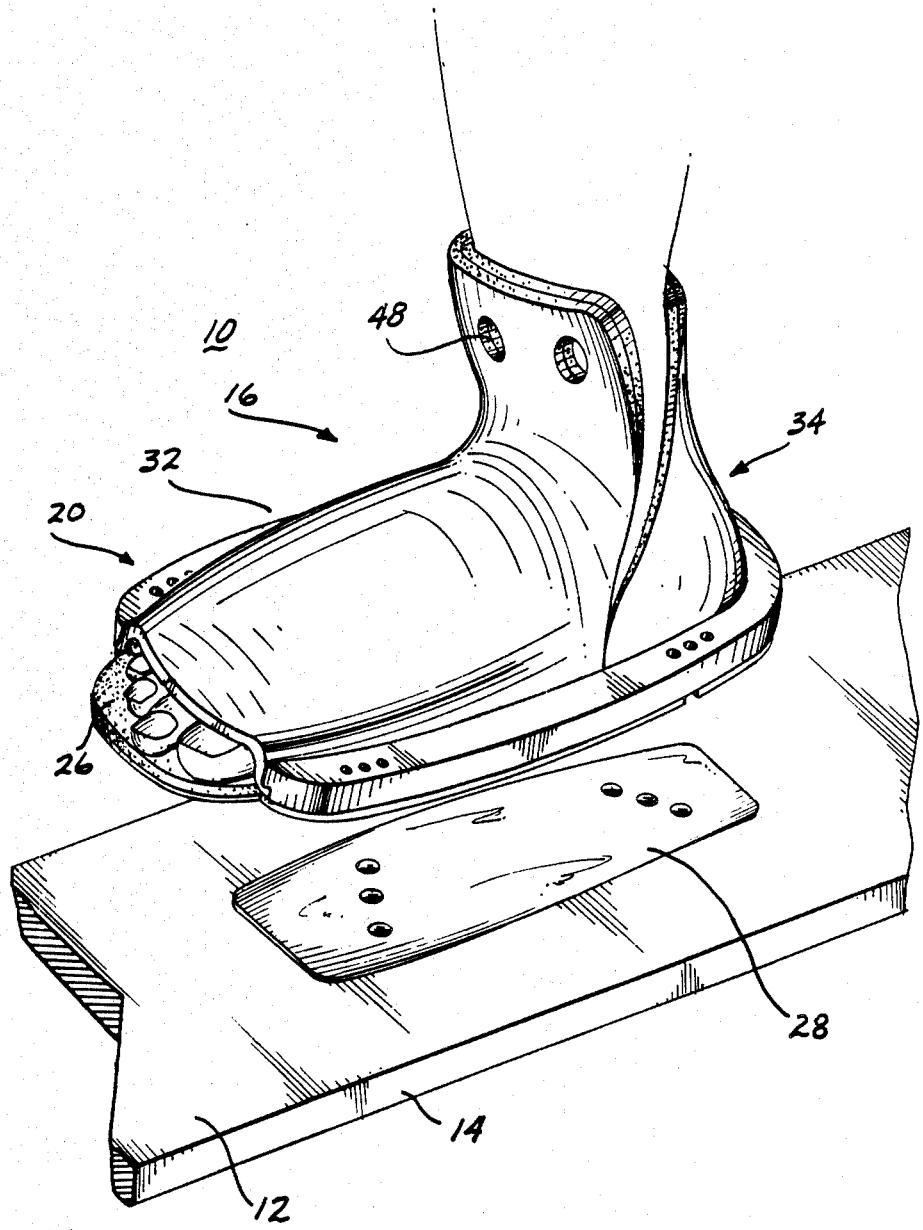
FIG. 2 is a partially exploded, isometric view of the present invention taken from substantially the same direction as FIG. 1 and illustrating a step in the formation of the binding base assembly.
Figure 3:
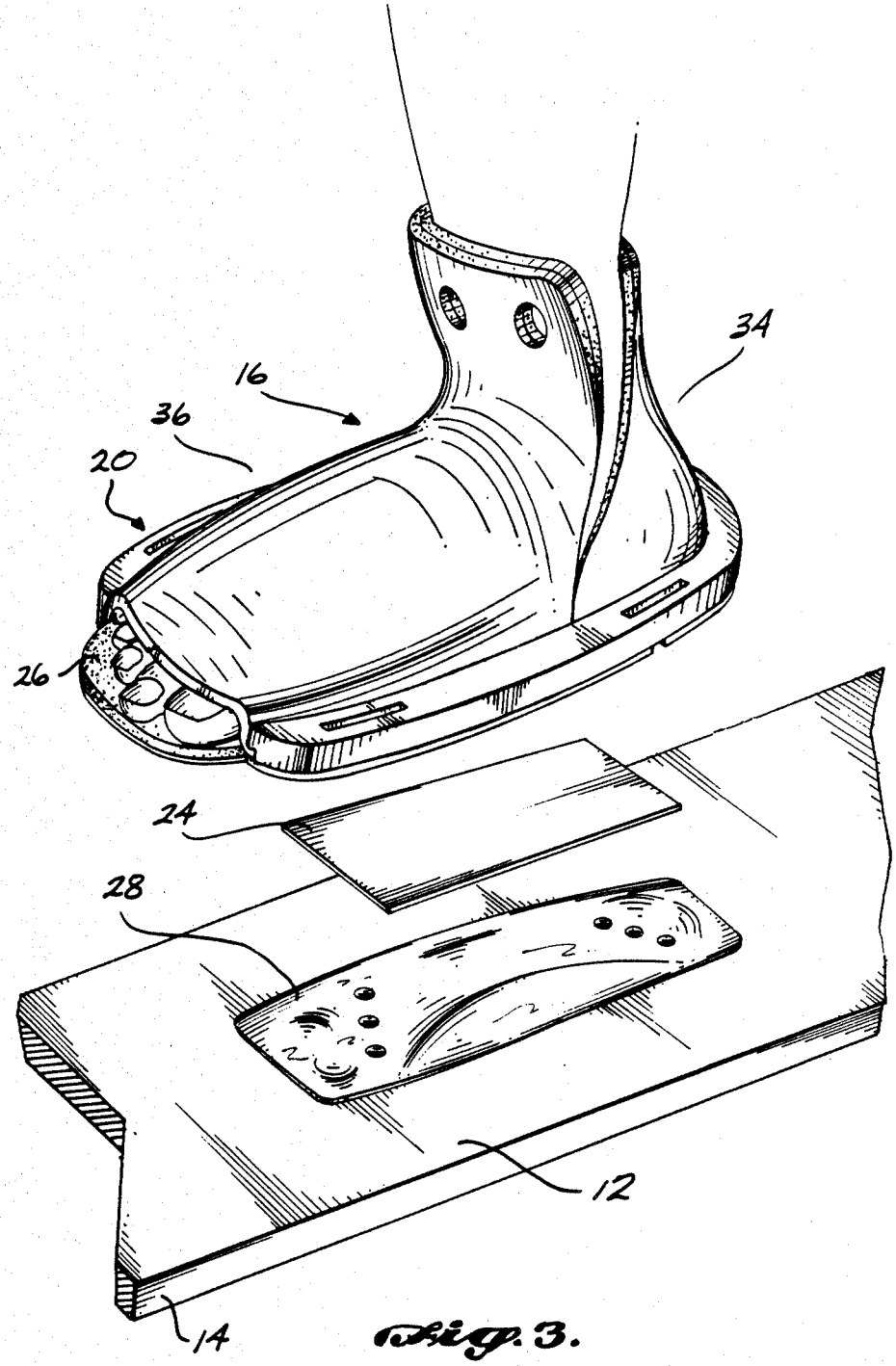
FIG. 3 is a view similar to FIG. 4 illustrating a further step in the process of forming the base assembly of the binding; and, FIG. 4 is an enlarged, fragmentary, cross-sectional view of an assembled binding of the present invention taken substantially across the arch region of the binding.

A water ski binding 10 constructed according to the best mode of the invention currently known to applicant is illustrated in the Figures as secured to the top surface 12 of a water ski 14. The water ski binding 10 in basic construction includes an elastic upper 16 secured to a base assembly 17 through the use of a generally U-shaped clamp 20 to form a subassembly which in turn is mounted on ski 14. The base assembly 17 includes a frame base 18 having a large opening 22 formed therein for reception of a separate soleplate 24 molded in the shape corresponding to the bottom of a foot. The base assembly 17 also includes a resilient foot pad 26 that overlies soleplate 24 and the frame base 18, and a viscous, flowable, pressure-compensating support pad 28 that underlies the soleplate 24 and frame base 18. The binding upper 16 in conjunction with base assembly 17 define a binding cavity 30 for receiving and restraining the foot, ankle and lower leg of the water skier.

Describing water ski binding 10 in more detail, binding upper 16 consists of two major components, a toe piece 32 and a heel piece 34. The toe piece includes an arcuate roof section 36 that curves upwardly and inwardly from the sides of the frame base 18 to extend over the top of the skier's foot. The toe piece 32 also includes a tongue 38 that extends upwardly from the rear of the roof section to overlay the front of the lower leg of the skier. Flanges 40 extend outwardly and horizontally from the lower perimeter side portions of the roof section 36. The front of the toe piece 32 is illustrated as being open; however, it alternatively can be closed.

The heel piece 34 includes a heel cup 42 which forms a continuation of roof section 36 thereby to cooperate with the roof section to define the binding cavity 30 and to substantially completely cover the foot and ankle region of the water skier. A flap 44, corresponding to tongue 38, extends upwardly from heel cup 42 to cover the rear side of the lower leg of the water skier. Heel piece 34 also includes a flange 46 which extends horizontally and outwardly from the lower perimeter portion of the heel cup to form a continuation of the flange 40 of heel piece 34.

To provide maximum comfort and support, toe piece 32 and heel piece 34 preferably are composed of composite material, having a plurality of layers serving different functions. Ideally, they include an inner layer of soft, foam rubber to cushion a skier's foot. The surface of the inner layer may also be gridded with slight protrusions of foam rubber to provide further cushion and less surface adhesion to the foot when inserted in and removed from, the binding. A second, stiffer outer layer of rubber ideally is employed to provide the necessary support for the skier's foot and akle. A greater number of layers can be used to provide the level of comfort, strength, flexibility and other characteristics desired. For additional convenience in donning and duffing the binding can, a pair of finger holes 48 are provided at the top portion of tongue 38 and a pair of comparable finger holes 50 are provided at the top portion of flap 44. The finger holes 48 and 50 allow the skier to obtain a firm grip on the potentially slippery tongue 38 and flap 44 and stretch the toe piece 32 and heel piece 34 to ease insertion and removal of the foot from binding cavity 30.

In the currently preferred embodiment of the present invention, toe piece 32 and heel piece 34 are molded by a process similar to that disclosed in U.S. Pat. No. 4,522,603. Thus, the toe piece and heel piece may be each intregally formed with an inner surface composed of, for instance, 0.25 inch (0.635 cm) thick textured neoprene foam or similar material having a durometer of about 8 to 10. Similarly, the outer surface may consist of, for example, from 0.125 inch (0.3175 cm) to 0.375 inch (0.925 cm) thick neoprene or similar material having a durometer of about 50.

Binding frame base 18 includes a thin, flat, elongate baseplate section 58 having a bottom mounting surface in contact with the top surface 12 of ski 14. Baseplate section 58 includes a forward toe end 60 and an arcuate rear heel end 62 with an open central section defined by opening 22, FIGS. 1 and 4. Preferably frame base 18 also is constructed with an inward abutment ridge 64 defined in part by a concave, inwardly disposed, support surface 66 and an outwardly disposed, sloping surface 68. Support surface 66 in cooperation with the baseplate section 58 and soleplate 24 define a supportive depression 70 that provides lateral support to the sole of the skier's foot positioned in the binding 10.

Figure 4:
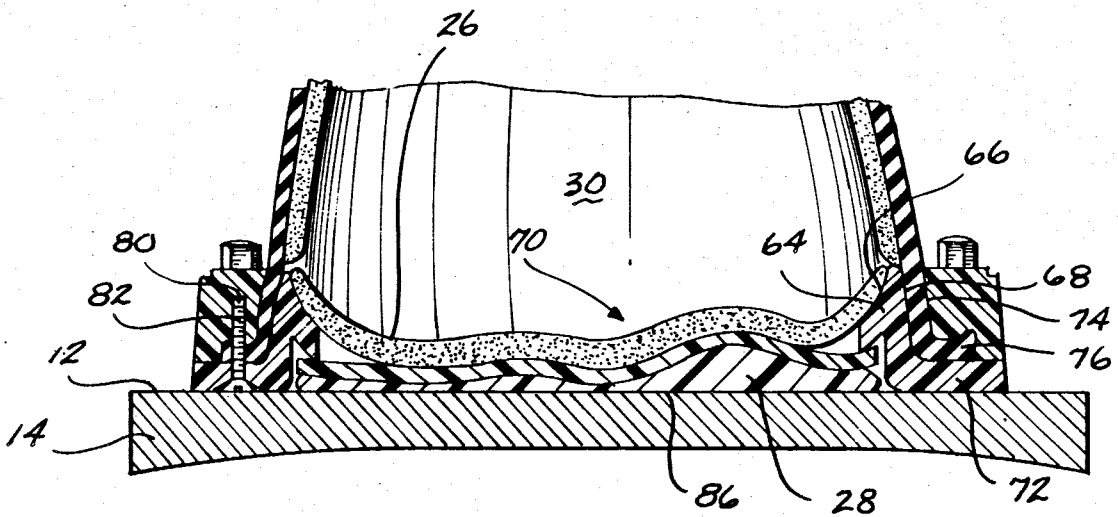

Frame base 18 also includes an outward, horizontal flange 72 extending horizontally and outwardly from abutment ridge 64 to define the top, horizontal clamping surface which bears against the under side of toe piece flange 40 and heel piece flange 46. A generally U-shaped clamp 20 is formed with longitudinal side portions interconnected by a curved rear portion to form the clamp in a shape corresponding to the shape of abutment ridge 64 and frame base flange 72. Clamp 20 includes an inwardly disposed, upwardly and inwardly sloped surface 74 to cooperate with the correspondingly sloped outer surface 68 of abutment ridge 64 to clamp the lower, upright perimeter portions of toe piece 32 and heel piece 34 therebetween. Clamp 20 is also formed with a generally horizontal bottom surface 76 disposed above the top surface of flange 72 to receive and clamp the flanges 40 and 46 of toe piece 32 and heel piece 34, respectively, therebetween. To this end a plurality of beveled clearance holes 78 are formed in flange 72 of frame base 18 in alignment with corresponding upwardly extending, threaded blind holes 80 formed in clamp 20 for reception of appropriate hardware members, such as screws 82, therein. When screws 82 are tightened, the flange portions 40 and 46 and the corresponding lower marginal portions of roof section 36 and heel cup 42 of toe piece 32 and heel piece 34, respectively, are securely clamped between frame base 18 and clamp 20. It should be noted, as shown in FIG. 4, that this arrangement allows the binding upper 16 to be secured to frame base 18 and clamp 20 without necessitating the use of holes in the lower upright perimeter portions of the toe piece or heel piece, which could result in reduced strength and eventually failure of the binding upper 16.

Preferably, frame base 18 and clamp 20 are constructed from rigid, high-strength but lightweight material, for instance a metal such as aluminum or plastic such as nylon with or without a reinforcing material. Forming frame base 18 and clamp 20 from a plastic material provides the advantage that these components may be economically molded as substantially complete units without requiring any significant subsequent machine or other finishing operations. Ideally, but not essentially, the abutment ridge 64, baseplate section 58 and flange 72 of the frame base 18 are constructed as an integral unit. However, these components can be separately formed and then bonded together with a suitable well-known commercially available agent, such as an adhesive or epoxy cement.

The base assembly 17 also includes a pressure-compensating support pad 28 composed of a viscous, flowable material encapsulated in a flexible, pliable envelope 86 that underlies and supports frame baseplate section 58 and soleplate 24. The composition of the support pad enables it to conform to the shape of the bottom of a water-skier's foot. The composition and construction of viscous, pressure-compensating flowable support materials, such as used in the support pad 28 are detailed in U.S. Pat. Nos. 3,615,972, 4,108,928 and 4,229,546 which are incorporated by reference herein. Also, such flowable materials and support pads are articles of commerce. For example, they are available from Alden Laboratory, Inc., P.O. Box 9012, Boulder, Colo. 80306, U.S.A., under the trademark FLOLITE.

As set forth in the above-identified patents and as an illustrative but not limiting example, the flowable material used in support pad 28 may include a plurality of discontinuous microbeads disposed in a liquid phase composed of oil, wax or a mixture of oil and wax. Ideally, the microbeads of the flowable material are in the form of hollow spheres having diameters in the range of about 10 to 300 microns and a density of about 0.5 to 0.70 gm/cm. As one alternative, the microbeads may be composed of silican material with or without added ceramic material. Such microbeads are sold under the designation ECCOSPHERES 1G25 by Emerson and Cuming, Inc., Canton, Mass., U.S.A. As a further alternative, the microbeads may be composed of heat expanded resin/plastic hollow spheres having a nucleus of thermally-responsive, encapsulated, liquified blowing or expanding agent, such as isobutane. The beads themselves may be composed of thermoplastic resinous polymeric material, for instance, a copolymer of methylmethacrylate, styrene, or vinylidene chloride. As a specific example, the microbeads may consist of SARAN Microspheres XD-8217 sold by the Dow Chemical Company of Midland, Michigan, USA.

The liquid phase of the flowable material utilized in support pad 28, as noted above, may be composed of oil, wax or a mixture of both. Suitable oils, for example, may include a petroleum-based oil, such as exemplified by CARNEA 21 oil, TUFFLO 6204 oil, TOPCO motor oil (S.A.E. 20), R Industrial #5-H oil from American Oil Company [having a typical pour point 300–220 sec. (S.U.V.) at 100° F., typical flash point of 450° F., typical pour point (max) of 0, and typical viscosity index (min.) of 95]are suitable admixtures thereof. Alternatively, the oil may be composed of a vegetable oil, such as coconut oil supplied by Sargent-Welch Scientific Company, Skokie, Ill, U.S.A.

The wax may be a suitable, natural, mineral, petroleum-based synthetic, vegetable, or animal wax [such asd beeswax, (e.g., SC 10979 beeswax (yellow), supplied by Sargent-Welch Scientific company, Skokie, Ill., U.S.A.)], paraffin wax, or microcrystalline wax. Preferably the wax, although deformable under pressure, is substantially incompressible and is an essentially nonflowable solid at temperatures below 110° F., but softens and flows at higher temperatures. Suitable microcrystalline waxes may include mixtures of alkylated naphthenes (saturated cycloparaffins) and isoparaffins with varying amounts of normal paraffins.

Examples of liquid phases composed of a mixture of wax and oil may include 85% by weight microcrystalline wax and 15% by weight petroleum oil. The microcrystalline wax may be composed of HM 1319 wax manufactured and sold by HB Fuller Company, St. Paul, Minn., U.S.A. This wax is light yellow, has a typical "application" temperature of 180° F. to 200° F., has a typical ring and ball softening point of 174° F. to 176° F. The petroleum oil of the mixture may be composed of TUFFLO 6204 oil supplied by the Atlantic Richfield Company.

Examples of preferred proportions of the microspheres and the liquid phase are set forth in the above-referenced patents. In general, to assure that the support pad is flowable and pressure-compensating, it is desirable that the volume of the liquid phase be substantially greater than the volume of the interstitial spaces of the microbeads, and to be present in a volume that is greater than the volume needed to merely thinly coat the outer surfaces of each of the microbeads. As one illustrative but nonlimiting example, the microsphere may compose from about 23 to 31% by weight, the composition of the flowable material and the wax and oil composing from about 10 to 21% and from about 47 to 64% by weight, respectively, the composition of the flowable material.

Envelope 86 which contains the microbeads and the liquid phase ideally is composed of flexible, pliable thermoplastic resinous material which is impervious to the microbeads and liquid phase. Suitable materials may include, for example, polyurethane. An illustrative but nonlimiting example of a commercially available polyurethane which may be employed to compose the envelope is TUFTANE TF-310 sold by B. F. Goodrich, General Products Company, Akron, Ohio, U.S.A.

By the above composition and construction, support pad 28 provides a controllable, pressure-compensating support for soleplate 24. The support pad is resistant to flow in response to instantaneously applied pressure but does flow in response to continuously applied pressure. The support pad 28 may be preshaped to correspond to the contour of the bottom of the skier's foot, thereby enabling the support pad to serve as a "form" for the thermoplastic soleplate 24. The support pad is preformed by having a skier stand on the support pad either directly with his foot or with his foot disposed within binding 10 but with the soleplate 24 removed so that only foot pad 26 is interposed between the bottom of the foot and the support pad 28. When the weight of the skier's foot is placed on the support pad, the microbead/liquid phase mixture slowly flows from locations of higher pressure to locations of lower pressure, e.g., to the arch region of the foot. Under room temperature this takes less than 2 minutes. Within this time period the flowable material has been displaced within envelope 78 to accommodate the shape of the bottom of the skier's foot and to equalize the pressure throughout the envelope. Once the support pad 28 has been preformed in this manner, it maintains its shape under normal ambient temperature ranges.

The base assembly 17 further includes soleplate 24 that, as previously mentioned, is sized to be receivable within the opening 22 formed in the baseplate section 58 of the frame base 18. Ideally, the thickness of the soleplate corresponds to the thickness of the baseplate 58. Also, ideally, the soleplate is composed of a suitable thermoforming material, for example, polyvinyl chloride polypropylene or an acrylic material having a thermoforming temperature in the range of 140° F. to 225° F. This temperature is high enough to prevent deformation of the support pad at normal ambient temperatures while being of low enough temperature to enable the soleplate to be in situ formed in binding 10. Other suitable thermal forming materials may include, for example, an expanded, cross-link polyethylene as discussed in U.S. Pat. No. 4,563,787, incorporated by reference herein.

In accordance with the present invention, soleplate 24 is in situ formed by heating the soleplate above its thermosoftening temperature and then placing the soleplate within the opening 22 with the support pad 28 disposed below the soleplate. Thereafter, the water skier places his foot, which may be disposed within a thermal insulating enclosure, such as a sock, on the heated soleplate. Alternatively and, preferably, the skier first places his foot within the binding cavity 30 so that foot pad 26 is interposed between the bottom of the skier's foot and the soleplate, in which case a thermal insulating sock may not be required. The pressure placed on the soleplate causes the soleplate to assume the shape of the underside of the skier's foot. Ideally, the skier maintains his weight on the soleplate until the temperature of the soleplate has lowered to below its thermoforming temperature. As discussed above, prior to the foregoing step of forming soleplate 24, support pad 28 may be preformed using the procedures delineated above. This enables the support pad 28 to serve as a "form" in conjunction with the underside of the skier's foot to facilitate the molding of the soleplate 24 into a shape corresponding to the underside of the skier's foot.

As most clearly illustrated in the FIGS. 1 and 4, base assembly 17 further includes a foot pad 26 disposed over soleplate 24, baseplate section 58 and the curved support surface 66 of abutment ridge 64 to form a continuation of the inside surface of toe piece 32 and heel piece 34. For comfort, ideally foot pad 26 is composed of a resilient but durable material. An example of such a material may include a neoprene sponge having a hardness of about 10 to 25 durometer.

There have been described preferred embodiments of a water ski binding having an in situ molded base assembly. It will be appreciated by those skilled in the art of the present invention that the techniques of this invention may be used to an advantage in any situation where it is desirable to provide a water ski binding having maximum support for the skier's foot, especially the underside of the skier's foot. Therefore, it is to be understood by those skilled in the art that various changes, additions, admissions may be made in the form and detail of the description of the present invention set forth above without departing from the spirit or essential characteristics thereof. The particular embodiments of the water ski binding and in situ molded base assembly described above are therefore to be considered in all respects as illustrative and not restrictive, i.e., the scope of the present invention is as set forth in the appended claims, rather than being limited to the examples of a water ski binding set forth in the foregoing description.

The embodiments of the invention in which an exclusive property or privilege is claimed are defined as follows:

1. A base assembly for a water ski binding, comprising:

a viscous, flowable, pressure-compensating first layer composed of particles of discontinuous microbeads and a liquid phase selected from the group consisting of oil, wax and oil together with wax; and, a second layer of thermoforming material formed at least in part into the three-dimensional contour of the bottom of a foot.

2. A water ski binding base assembly according to claim 1, wherein the first layer is shaped into the contour of the bottom of the foot.

3. A water ski binding base assembly according to claim 2, wherein the three-dimensional contour of the second layer corresponds at least in part to the contour of the first layer.

4. A base assembly for a water ski binding, comprising:

a viscous, flowable, pressure-compensating first layer shaped into the contour of the bottom of a foot and composed of particles of discontinuous microbeads and a liquid phase selected from the group consisting of oil, wax and oil together with wax;

a second layer of thermoforming material formed at least in part into the contour of the bottom of the foot;

wherein the contour of the second layer is derived at least in part from the contour of the first layer; and, wherein the first layer is disposed below the second layer.

5. A water ski binding base assembly according to claim 4, further including a resilient third layer disposed above the second layer.

6. A water ski binding base assembly according to claim 1, further comprising a third resilient layer disposed above the first and second layers.

7. A water ski binding base assembly according to claim 1, wherein the microbeads and the liquid phase are encapsulated in an envelope of pliable material substantially impervious to the microbeads and the liquid phase.

8. A base assembly for a water ski binding, comprising:

a viscous, flowable, pressure-compensating first layer composed of particles of discontinuous microbeads and a liquid phase selected from the group consisting of oil, wax and oil together with wax, said first layer being at least in part formable into the three-dimensional contour of the bottom of a foot; and, a second layer of thermoforming material, said second layer upon being heated to its thermoforming temperature and placed in pressurized contact with said first layer, being deformable to correspond to the three-dimensional contour of the bottom of the foot.

9. A water ski binding base assembly according to claim 8, wherein the first layer is preformed into a contour corresponding to the contour of the bottom of a foot.

10. A base assembly for a water ski binding, comprising:

a viscous, flowable, pressure-compensating first layer composed of particles of discontinuous microbeads and a liquid phase selected from the group consisting of oil, wax and oil together with wax, said first layer being preformed into a contour corresponding to the contour of the bottom of a foot;

a second layer of thermoforming material formed at least in part into the contour of the bottom of a foot wherein the contour of the second layer being derived at least in part from the contour of the first layer; and, a baseplate having an opening formed therein in a shape corresponding to the second layer to receive the second layer within said opening.

11. A water ski binding base assembly according to claim 10, wherein the first layer is disposed below the baseplate and the second layer.

12. A water ski binding base assembly according to claim 8, wherein the first layer is encased within an envelope of pliable material substantially impervious to the microbeads and the liquid phase.

13. A base assembly for a water ski binding comprising:

a viscous, flowable, pressure-compensating first layer composed of particles of discontinuous microbeads and a liquid phase selected from the group consisting of oil, wax and oil together with wax;

a second layer of thermoforming material formed at least in part into the contour of the bottom of a foot;

a baseplate having an opening formed therein in a shape corresponding to the second layer to receive the second layer within said opening, the baseplate including marginal rear and side portions corresponding to the rear and side portions of a foot; and, further comprising an abutment ridge extending along the rear and a majority of the side marginal portions of the baseplate to an elevation sufficiently above the elevation of the baseplate whereby the second layer, the baseplate and the abutment ridge cooperatively define a foot-receiving depression to provide lateral and rear support for the foot.

14. A water ski binding, comprising a binding upper mounted on a base assembly, said base assembly comprising:

a viscous, flowable pressure-compensating first layer composed of particles of discontinuous microbeads and a liquid phase selected from the group consisting of oil, wax and oil together with wax, said first layer shaped into the contour of the bottom of a foot;

a baseplate overlying said first layer and having an opening formed therein corresponding to at least the arch region of the foot; and, a second layer of thermoforming material disposed within the opening forming the baseplate and formed into the contour of the bottom of the foot, the contour of the second layer being derived at least in part from the contour of the first layer.

15. The water ski binding according to claim 14, wherein the second layer is in situ molded in the binding to conform to the shape of the underlying first layer and the bottom of the foot.

16. A method of forming a base assembly for a water ski binding, comprising:

placing a viscous, flowable pressure-compensating first base assembly layer on a support surface, said first base assembly layer composed of particles of discontinuous microbeads and a liquid phase selected from the group consisting of oil, wax and oil together with wax;

placing a second base assembly layer of thermoforming material on top of the first base assembly layer, said second base assembly layer being previously heated to a temperature above its thermoforming temperature; and, placing the foot of the water ski binding wearer on the second base assembly layer to mold the second base assembly layer into the shape of the bottom of the wearer's foot.

17. The method according to claim 16, further comprising placing the wearer's foot on the first base assembly layer to mold the first base assembly layer into the shape of the bottom of the wearer's foot prior to placement of the second base assembly layer on the first base assembly layer.

18. The method according to claim 16, further comprising placing a third base assembly layer of resilient material over the second base assembly layer prior to placement of the wearer's foot on the base assembly in conjunction with the molding of the second base assembly layer into the shape of the bottom of the wearer's foot.

19. The method according to claim 16, further comprising prior to placement of the second base assembly layer on the first base assembly layer, placing a baseplate on the first base assembly layer, said baseplate having an opening formed therein and then placing the second base assembly layer within the opening formed in the baseplate.

20. The method according to claim 19, further comprising forming the baseplate with a soleplate and an abutment ridge curving upwardly from the soleplate to an elevation above the soleplate whereby the second base assembly layer, the soleplate and the abutment ridge cooperatively define a foot-receiving depression to provide side and rear support for the wearer's foot.

21. A water ski binding base assembly according to claim 8, wherein the pressurized contact of the second layer with the first layer is generated by a foot.

22. A water ski base assembly according to claim 8, wherein the second layer is disposed above the first layer.

23. A water ski base assembly according to claim 8, further comprising a baseplate having an opening therein to receive the second layer within said opening.

24. A method according to claim 16, wherein the foot of the water ski binding wearer is disposed within a binding cavity at the time the foot is placed on the second layer of the base assembly.

25. A method for forming a base assembly for a water ski binding, comprising:

placing on a support surface in stacked relationship to each other a first viscous, flowable, pressure-compensating layer and a second layer of thermoforming material, wherein said first base assembly layer comprises particles of discontinuous microbeads in a liquid phase selected from the group consisting of oil, wax, and oil together with wax, wherein said second base assembly layer has been previously heated to a temperature above its thermoforming layer; and, placing the foot of the water ski binding wearer on the stacked first and second layers to mold the layers into a shape corresponding to the shape of the bottom of the wearer's foot.

* * * * *